US010279453B2

(12) United States Patent
Herre et al.

(10) Patent No.: US 10,279,453 B2
(45) Date of Patent: May 7, 2019

(54) DRY-ICE CLEANING IN A PAINTING INSTALLATION

(71) Applicant: Durr Systems GmbH, Bietigheim-Bissingen (DE)

(72) Inventors: Frank Herre, Oberriexingen (DE); Marcus Frey, Weil der Stadt (DE); Michael Baumann, Flein (DE); Georg M. Sommer, Ludwigsburg (DE); Thomas Buck, Sachsenheim (DE)

(73) Assignee: Durr Systems GmbH, Bietigheim-Bissingen (DE)

( * ) Notice: Subject to any disclaimer, the term of this patent is extended or adjusted under 35 U.S.C. 154(b) by 1215 days.

(21) Appl. No.: 14/386,013

(22) PCT Filed: Mar. 28, 2013

(86) PCT No.: PCT/EP2013/000955
§ 371 (c)(1),
(2) Date: Feb. 23, 2015

(87) PCT Pub. No.: WO2013/143707
PCT Pub. Date: Oct. 3, 2013

(65) Prior Publication Data

US 2015/0158145 A1 Jun. 11, 2015

(30) Foreign Application Priority Data

Mar. 30, 2012 (DE) ..... 10 2012 006 567

(51) Int. Cl.
*B24C 1/00* (2006.01)
*B24C 5/02* (2006.01)
(Continued)

(52) U.S. Cl.
CPC ..... *B24C 1/003* (2013.01); *B05B 7/0416* (2013.01); *B05B 14/40* (2018.02); *B08B 7/00* (2013.01);
(Continued)

(58) Field of Classification Search
CPC ..... B05B 14/40; B08B 7/00; B24C 1/003; B24C 3/18; B24C 3/22; B24C 3/28;
(Continued)

(56) References Cited

U.S. PATENT DOCUMENTS 5,472,369 A * 12/1995 Foster ..... B08B 7/02 134/38
5,782,253 A * 7/1998 Cates ..... B08B 7/0035 134/105
(Continued)

FOREIGN PATENT DOCUMENTS

CN 1358580 A 7/2002
CN 101124065 A 2/2008
(Continued)

OTHER PUBLICATIONS

International Search Report and Written Opinion dated Jul. 24, 2013 (8 pages).

*Primary Examiner* — Timothy V Eley
(74) *Attorney, Agent, or Firm* — Bejin Bieneman PLC

(57) ABSTRACT

A painting-installation cleaning system is provided for cleaning at least one component of a painting installation, in particular at least one component of a painting robot or of a handling robot, characterized by at least one dry-ice nozzle for producing a dry-ice jet which cleans the component.

12 Claims, 4 Drawing Sheets

Figure 1:
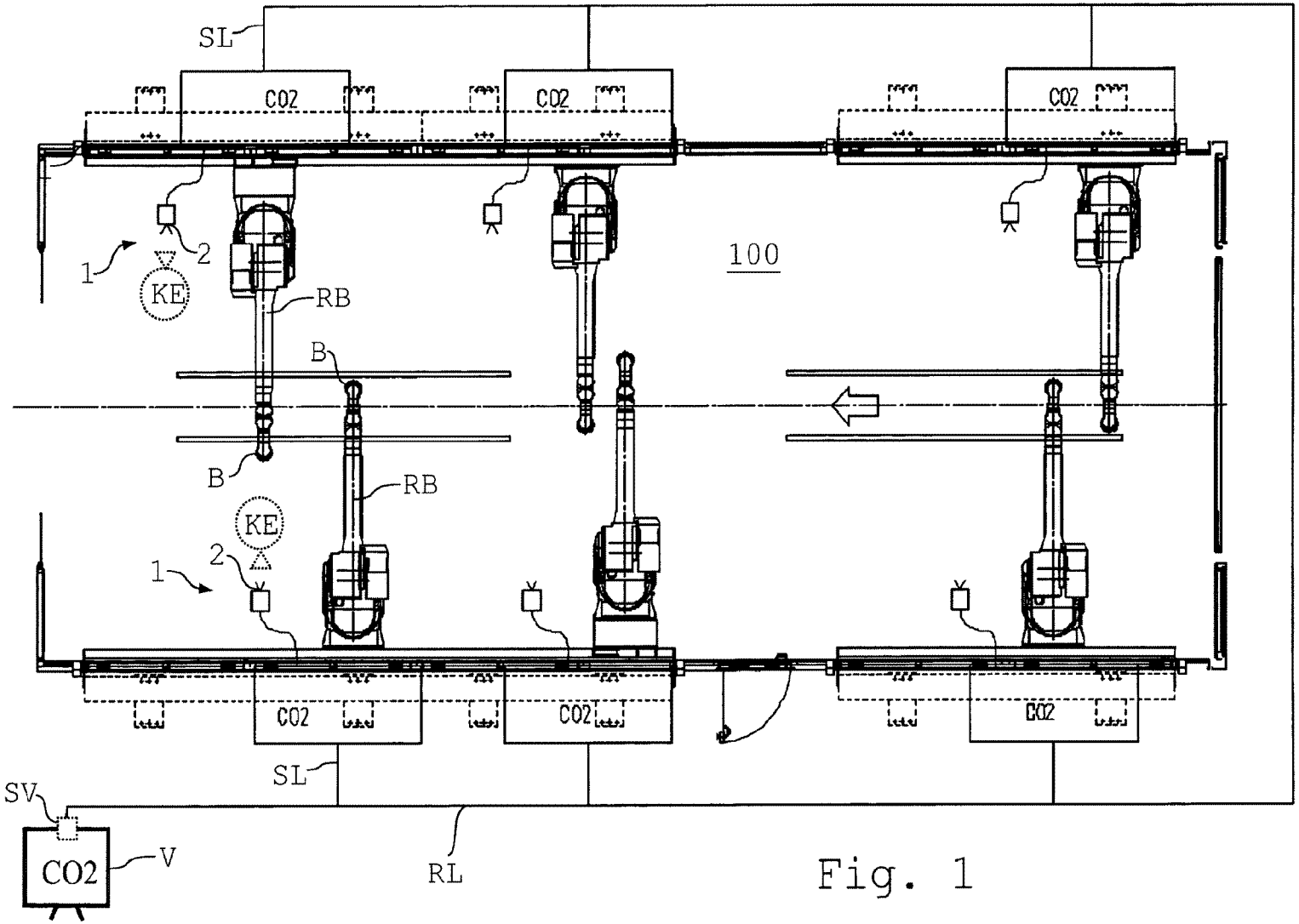

(51) Int. Cl.

| | |
|---|---|
| ***B24C 7/00*** | (2006.01) |
| ***B05B 14/40*** | (2018.01) |
| ***B05B 7/04*** | (2006.01) |
| ***B08B 7/00*** | (2006.01) |

(52) U.S. Cl.
CPC ..... *B08B 7/0092* (2013.01); *B24C 5/02* (2013.01); *B24C 7/0053* (2013.01)

(58) Field of Classification Search
CPC ..... B24C 5/02; B24C 7/0046; B24C 7/0053; B24C 9/00
See application file for complete search history.

(56) References Cited

U.S. PATENT DOCUMENTS

| | | | | |
|---|---|---|---|---|
| 6,004,190 | A * | 12/1999 | Trampusch | B24C 1/003 451/38 |
| 6,516,645 | B2 * | 2/2003 | Morales | B08B 7/0092 29/90.7 |
| 7,293,570 | B2 | 11/2007 | Jackson | |
| 7,967,664 | B2 | 6/2011 | Elbing et al. | |
| 8,726,830 | B2 * | 5/2014 | Herre | B05B 13/0292 118/70 |
| 2002/0082179 | A1 | 6/2002 | Okazawa et al. | |
| 2003/0104764 | A1 * | 6/2003 | Preising | B24C 1/003 451/39 |
| 2006/0124156 | A1 | 6/2006 | Jackson | |
| 2007/0089762 | A1 * | 4/2007 | Baumann | B05B 15/0258 134/34 |
| 2008/0092923 | A1 | 4/2008 | Elbing et al. | |
| 2008/0236633 | A1 * | 10/2008 | Von Der Ohe | B23K 9/32 134/34 |
| 2011/0045194 | A1 * | 2/2011 | Herre | B05B 13/0292 427/421.1 |
| 2014/0137910 | A1 * | 5/2014 | Johnston | B08B 9/093 134/198 |
| 2015/0122288 | A1 * | 5/2015 | Eriksson | B08B 9/08 134/7 |

FOREIGN PATENT DOCUMENTS

| | | | |
|---|---|---|---|
| DE | 1051815 | B | 3/1959 |
| DE | 19926119 | A1 | 12/2000 |
| DE | 10251815 | A1 | 5/2004 |
| DE | 102005002365 | B3 | 4/2006 |
| DE | 102007027618 | A1 | 12/2008 |
| DE | 102007033788 | A1 | 1/2009 |
| JP | H05-115830 | A | 5/1993 |
| JP | H05-331689 | A | 12/1993 |
| JP | H10-202210 | A | 8/1998 |
| JP | 2002-035659 | A | 2/2002 |
| JP | 2002-200464 | A | 7/2002 |
| JP | 2003-225596 | A | 8/2003 |
| JP | 2003-311228 | A | 11/2003 |
| JP | 2004-322007 | A | 11/2004 |
| JP | 2004-358312 | A | 12/2004 |
| JP | 2006-043502 | A | 2/2006 |
| JP | 2007-049065 | A | 2/2007 |
| JP | 2007-253062 | A | 10/2007 |
| JP | 2008-522813 | A | 7/2008 |
| JP | 2009-090188 | A | 4/2009 |
| JP | 2009-131743 | A | 6/2009 |
| WO | 0117726 | A1 | 3/2001 |
| WO | 2006016149 | A2 | 2/2006 |
| WO | 2012163491 | A1 | 12/2012 |

* cited by examiner

DRY-ICE CLEANING IN A PAINTING INSTALLATION

CROSS-REFERENCE TO RELATED APPLICATIONS

This application claims priority to PCT International Application No. PCT/EP2013/000955, filed Mar. 28, 2013, which is in turn based upon and claims benefit of priority from German Patent Application No. DE 10 2012 006 567.1, filed Mar. 30, 2012, the entire contents of which prior applications are incorporated herein by reference.

BACKGROUND

The present disclosure relates to a system and method of cleaning at least one component of a painting installation, e.g., cleaning a component of a painting robot or of a handling robot. The phrase "cleaning system" in this disclosure means a system that in addition to cleaning components may also comprise the components to be cleaned and optionally motional devices therefor and also possibly necessary program controls, motion controls and other, e.g., automatic control means.

When motor-vehicle bodies and their attachment parts are painted, soiling of the components used in the painting installation, such as atomisers, door or bonnet openers ("opener tools"), gratings, robot parts, painting booth walls, etc., due to emitted paint mist, drops of paint, paint overspray, etc. inevitably occurs. Various cleaning systems and cleaning methods are known for the cleaning which is therefore necessary at regular intervals, but these involve some disadvantages.

A conventional cleaning method is a spray-cleaning method using flushing agents and compressed air for drying the components to be cleaned. A further conventional cleaning method is a mechanical cleaning method with a brush, which is mostly used in combination with the spray-cleaning method.

Disadvantages of these conventional cleaning methods are the long time which is necessary for drying, the consumption of flushing agent and the overall size of the cleaning equipment necessary. In the case of the mechanical cleaning method with a brush there is furthermore the disadvantage that the brush is prone to wear and can itself be soiled by paint. Furthermore, detached bristles may be left behind on the components to be cleaned and later, during the painting process, fall e.g. onto motor-vehicle bodies or their attachment parts which are to be coated, and damage them.

There is therefore a need to provide an alternative and/or improved cleaning system, suitable for a painting installation, for cleaning components of a painting installation.

DESCRIPTION

Disclosed herein is a cleaning system, suitable for a painting installation, for cleaning at least one component of the painting installation, e.g., at least one component of a painting robot or of a handling robot, wherein at least one dry-ice nozzle for producing a dry-ice jet that cleans the component, and typically for applying dry ice to the component to be cleaned, is provided. In the context of this disclosure, "dry ice" covers at least one of the following: snow (preferably carbon dioxide snow), dry snow, carbon dioxide ($CO_2$) and/or a two-phase carbon dioxide mixture which comprises carbon dioxide gas and carbon dioxide particles. In the context of this disclosure, "dry ice" alternatively or additionally covers any grain sizes in a solid aggregate state and/or in the form of individual particles. Furthermore, in the context of this disclosure the dry ice or generally the carbon dioxide may be admixed and/or admetered to an expediently pressurised carrier gas.

This disclosure for the first time provides a cleaning system with at least one dry-ice nozzle for spraying dry ice onto a component to be cleaned, wherein both the cleaning system per se and the dry ice which is to be applied and/or sprayed are configured for use in a painting installation. Not only the cleaning system per se, but also the dry ice produced, has to be configured for use in a painting installation (e.g. explosion-protected, paint-resistant and solvent-resistant, etc.). Thus, conventional dry-ice configurations which are applied for cleaning purposes are unsuitable for use in painting installations, e.g., because the carbon dioxide particles are too small or too large, with the consequence that paint which is to be removed cannot be removed appropriately and/or that the sensitive components which are to be cleaned are damaged.

The cleaning of objects by spraying with dry ice is known. However, from the above explanation it arises that known dry-ice cleaning methods and dry-ice cleaning systems are unsuitable for automated use in painting installations, e.g., because of a lack of paint resistance, lack of flushing-agent/solvent resistance, lack of freedom from substances that impair paint-wetting; lack of explosion protection, which is imperative in painting installations, unsuitable dry-ice configuration, etc.

In an embodiment, a robot is provided that guides the component to be cleaned and that may be configured such that it positions the component to be cleaned in front of the dry-ice nozzle and/or moves (e.g., rotates, moves transversely and/or rectilinearly translationally) it relative to the dry-ice nozzle during the cleaning operation, as a result of which the component to be cleaned can be cleaned, e.g., over its entire outer periphery.

The distance between the dry-ice nozzle and the component to be cleaned, i.e., between the nozzle mouth and the surface of the component which is to be cleaned, may be between 1 mm and 30 mm during jet exposure. In this case, the jet exposure angle of the nozzle relative to the component surface can be expediently selected according to requirements.

The nozzle may also be oriented relative to the component such that the surface to be cleaned is influenced and/or exposed merely indirectly by the dry-ice jet, since even "spraying-past" of the dry ice past the object to be cleaned can have a cleaning effect. In such case, the cooling of the soiling, e.g. by carbon-dioxide carrier gas flowing past, makes the soiling brittle and then detaches it.

In particular with such, but also with other, embodiments, the dry-ice nozzle may be arranged in stationary manner.

Further, the surface to be cleaned (for example of an atomiser) may be divided into a plurality of cleaning sections, which are then approached and cleaned sequentially and in a freely parametrisable sequence. These cycles can be set in freely parametrisable manner and corresponding to the soiling. Fixedly set cycles are also possible.

Between the individual cleaning operations and sections, the component to be cleaned can again and again perform its actual function in the painting booth. Merely all the sections together then yield a completely clean component.

The cycles and/or times when the individual sections are cleaned can be freely programmed and set.

It is likewise possible to place the various sections in various dependencies with one another, so that one part, for example the lower part of a painting means, is always cleaned before the other sections. This can be achieved with special software and a cycle counter accounting for the dependencies.

It is possible for the dry-ice nozzle to be carried by a robot and to be movably guidable by the robot. The robot may be configured such that it positions the dry-ice nozzle in front of the component to be cleaned and/or moves (e.g., rotates, moves transversely and/or rectilinearly translationally) it relative to the component to be cleaned during the cleaning operation, as a result of which the component to be cleaned can be cleaned, e.g., over its entire outer periphery.

In one special embodiment of this disclosure, the robots are configured such that both the dry-ice nozzle and the component to be cleaned are moved during the cleaning process. The movement of the dry-ice nozzle and of the component to be cleaned can take place in opposite directions and/or in succession or simultaneously.

The dry-ice nozzle may, e.g., be mounted fixedly on a robot. It is, however, also possible for the dry-ice nozzle to be mounted exchangeably on a robot and, e.g., before a cleaning process to be automatically picked up/exchanged by a robot and/or after a cleaning process to be automatically put down/exchanged by a robot.

In one embodiment, a robot carries both an atomiser or a handling tool (e.g. a gripping tool of a handling robot) and also the dry-ice nozzle. The dry-ice nozzle in such case is expediently attached to the robot such that the function of the atomiser or of the handling tool is not impaired by the dry-ice nozzle. Expediently, the dry-ice nozzle may be shielded from the atomiser or the handling tool e.g. by means of a covering.

The dry-ice nozzle may be designed to be adjustable in its nozzle contour and/or in its orientation, e.g., to permit adaptation to different outer contours of the component to be cleaned, to be able to be directed at the component to be cleaned in different orientations (e.g., different cleaning angles), and/or to be able to emit the dry ice from the dry-ice nozzle with different jet configurations (e.g., different jet divergence angles, different jet widths, etc.). For this purpose, the cleaning system may comprise corresponding setting mechanisms which are operatively connected with the dry-ice nozzle.

In an embodiment, a plurality of dry-ice nozzles is provided.

It is possible that dry-ice nozzles are positioned or can be positioned at the same height, e.g., to be able to clean different regions of the outer periphery of the component which is to be cleaned simultaneously. Alternatively or additionally, it is possible that dry-ice nozzles are positioned or can be positioned at different heights, e.g., in order to be able to clean regions of the component to be cleaned which differ in height (e.g., a bell cup, an electrode-holder portion, e.g., electrode ring or electrode fingers, and/or a hand axis of a robot) simultaneously.

The dry-ice nozzles are arranged or can be arranged such that they cover the preferably entire outer periphery of the component to be cleaned during the cleaning operation.

It is possible for the dry-ice nozzle to be directed downwards during a cleaning operation, so that detached dirt particles are carried away downwards. This can be achieved, e.g., by the dry-ice nozzle adjustment function mentioned and/or by the robot carrying the dry-ice nozzle.

Alternatively or additionally, it is possible that a protective element is provided (e.g., a protective sheet or a housing or a collecting funnel with or without suction removal means) in order to prevent dirt particles detached during cleaning or dry ice from striking a component which is to be painted.

The cleaning system may be constructed such that internal flushing processes, e.g., of an atomiser, can take place in parallel with the cleaning by the dry ice, namely expediently independently of the atomiser orientation (e.g., bell-plate axis obliquely in space; pipe, sheets for collecting, deflecting the media which are atomised by means of the bell cup, etc.).

The component to be cleaned may be at least one of the following: an atomiser which is guided by a painting robot; a grip (e.g., an opener or opener tool of a handling robot, e.g., for opening doors, bonnets or flaps); a hand axis of a robot; a proximal robotic arm of a robot; a distal robotic arm of a robot; a booth wall of a painting booth, e.g., a windowpane in the booth wall; a floor of a painting booth, e.g., a grating in the floor of the painting booth; a guide rail for a robot (e.g., for displacing the robot); a conveyor for transporting components to be painted through the painting installation; an electrode holding ring of an atomiser; light arrays; silhouettes; silhouette doors; components to be painted; and/or a frame for hanging components to be painted. In brief, all the components of a painting installation which may be contaminated by paint particles, e.g., overspray, can be cleaned by the cleaning system.

The cleaning system may be equipped, e.g., with a supply device for supplying the dry-ice nozzle with the dry ice or carbon dioxide for producing dry ice. Further, a ring line for connecting the supply device to a plurality of dry-ice nozzles via respectively one stub line which branches off from the ring line to the respective dry-ice nozzle may be provided.

It is possible that a sensor, e.g., a camera sensor, is provided which determines the cleaning result. In the context of this disclosure, this also covers monitoring of the cleaning operation. Furthermore, e.g., a temperature sensor may be provided which determines the temperature of the component to be cleaned. By this the cleaning performance (e.g., the cleaning result) can be expediently monitored, e.g., quasi online. The atomiser might partially evaluate the cleaning result itself, e.g., by measuring the current and/or the voltage during stoppage/idle running. The success of the cleaning or generally the cleaning result can be determined therefrom.

The dry ice may be at least partially a carbon dioxide mixture which comprises carbon dioxide gas and carbon dioxide particles. The dry ice emitted by the dry-ice nozzle is thus preferably two-phase or multiphase (comprising carbon dioxide gas and carbon dioxide particles, optionally with conveying air or another carrier gas).

The cleaning system, e.g., the dry-ice nozzle, is configured such that the carbon dioxide, e.g., the carbon dioxide mixture, is miscible with a pressurised carrier gas before it emerges from the dry-ice nozzle, e.g., can be admixed to a pressurised carrier gas. For this purpose, the cleaning system may comprise a carrier-gas supply means and/or a mixing device (e.g. a mixing chamber or the agglomeration chamber mentioned below) for mixing carbon dioxide, e.g., the carbon dioxide mixture, with the pressurised carrier gas. The pressurised carrier gas may be compressed air. The carbon dioxide in the context of the invention can be admixed to the carrier gas and/or vice versa. The cleaning system is consequently expediently configured to mix carbon dioxide, e.g., the two-phase carbon dioxide mixture, with a pressurised carrier gas.

It is possible for the cleaning system to comprise a heating mechanism for heating the pressurised carrier gas.

Further, it may be expedient, following the cleaning, for the surface to be cleaned to be heated with hot air using a subsequent blower, in order to prevent conditions from dropping below the dew point at the surface of the object to be cleaned. The heating may also take place with other heating methods, such as for example with infrared radiation and other methods known from the prior art.

Furthermore, it is possible to supply the object to be cleaned with hot air through internal channels in order to heat it. Further, an electric heating device such as a heating coil or a heating wire may also be incorporated in the object in order to prevent excessive cooling of the surface.

The cleaning system may comprise an agglomeration chamber, to which fluid carbon dioxide can be supplied and in which a carbon dioxide mixture which comprises carbon dioxide gas and carbon dioxide particles and thus expediently is designed to be two-phase can be formed by agglomeration of carbon dioxide snow crystals. The carbon dioxide, e.g., the carbon dioxide mixture, can be mixed with a pressurised carrier gas (e.g. compressed air) in the agglomeration chamber and/or the mixing chamber mentioned, e.g., can be admetered thereto via a metering means.

The mixing chamber and the agglomeration chamber may be connected together, e.g., via a metering opening. It is, however, also possible for the agglomeration chamber and the mixing chamber to overlap at least partially, or for the agglomeration chamber and the mixing chamber to be one and the same chamber. The mixing and/or agglomeration chamber may be arranged close in front of the dry-ice nozzle or in said nozzle.

The liquid carbon dioxide supplied to the agglomeration chamber may be relaxed in the agglomeration chamber and/or converted at least partially into carbon dioxide crystals, which are compressed and/or agglomerated.

The cleaning system may comprise at least one setting mechanism (e.g., a control and/or regulating mechanism) to set the quantity, pressure and/or temperature of the carrier gas for the carbon dioxide and/or of the carbon dioxide for producing the dry ice, as a result of which expediently the cleaning action can be influenced, e.g., before and/or during the cleaning operation. The setting can be controlled in a closed control loop.

For temperature control purpose, for example, a through-flow cooler may be inserted between the agglomeration chamber and the carbon dioxide supply to permit temperature control of the carbon dioxide. The temperature control of the cooler may be freely parametrisable, also via the robot control.

Furthermore, it is possible that a device which prevents gas bubbles of the liquid $CO_2$ supply which may occur in the feed line, e.g., with a buffer bottle, is contained in the $CO_2$ supply to thus obtain a stable cleaning result.

The cleaning system may furthermore comprise at least one checking unit for checking (e.g., monitoring, detecting, etc.) at least one parameter which allows a conclusion to be drawn about at least one of the following, e.g., which indirectly or directly describes one of the following: pressure, quantity and/or temperature of the carbon dioxide for producing the dry ice; pressure, quantity and/or temperature of the dry ice itself; pressure, quantity and/or temperature of the carrier gas; room temperature; cleaning distance between dry-ice nozzle and component to be cleaned; position of the component to be cleaned; orientation of the component to be cleaned; position of the dry-ice nozzle; orientation (e.g., cleaning angle) of the dry-ice nozzle; and/or temperature of the component to be cleaned. The checking unit may comprise, e.g., measurement and/or sensor means.

It is likewise possible to use an apparatus for increasing the carbon-dioxide pressure to then parameterise and vary it freely, corresponding to the cleaning process, via a checking unit.

It is possible that dependent on at least one of the above-mentioned monitored parameters by at least one setting mechanism (e.g. a control and/or regulating mechanism) at least one output variable of the cleaning system can be set and that the output variable is selected from at least one of the following: orientation (e.g., cleaning angle) of the dry-ice nozzle relative to the component to be cleaned; quantity, pressure and/or temperature of the carbon dioxide for producing the dry ice; quantity, pressure and/or temperature of the dry ice itself; quantity, pressure and/or temperature of the carrier gas; cleaning distance between dry-ice nozzle and component to be cleaned; cleaning duration; cleaning interval; positioning and/or movement parameters of the robot carrying the dry-ice nozzle; and/or positioning and/or movement parameters of the robot carrying the component to be cleaned.

The cleaning system is expediently designed to be explosion-protected, e.g., by means of earthed elements, explosion-protection compliant electrical elements, electrically conductive materials, etc. For this purpose, the legal bases for explosion protection of the countries, such as ATEX directive 94/9/EG for Europe, have to be complied with. Alternatively or additionally, the cleaning system may comprise a valve which for safety reasons preferably automatically closes or at least reduces an emission of carbon dioxide if a potential, e.g., imminent, excessive escape of carbon dioxide or one which has already taken place is ascertained by a detection mechanism (e.g., a sensor).

The cleaning system and e.g., the dry-ice nozzle may be configured such that it can clean the component to be cleaned by the dry ice in a substantially exposed manner, so that, e.g., cleaning receptacles which are conventional in the prior art and into which the atomisers to be cleaned have to be introduced are not necessary. However, embodiments with a cleaning receptacle into which the components to be cleaned can be guided to be cleaned by the dry ice in the cleaning receptacle are also covered by this disclosure. In the exposed cleaning variant, the cleaning system can comprise an air-stream generation means which generates a downwards air stream in order to guide cleaned-off dirt or emitted dry ice downwards, e.g., via a painting booth floor (e.g., a grating) out of a painting booth.

The setting of pressure and/or temperature of the carrier gas and/or of the carbon dioxide can take place preferably by a pressure regulator and/or a proportional valve, e.g., to influence the amounts consumed and/or the cleaning action. These may be arranged centrally or in decentralised manner, wherein carbon dioxide control valves are arranged in the vicinity of the dry-ice nozzles. The actuation may, however, take place centrally.

Further, the carrier gas may be pressurised (e.g. compressed air). The carrier gas serves, e.g., to accelerate the dry ice (e.g., in the form of the two-phase carbon dioxide mixture) preferably to supersonic speed.

The acceleration of the mixture of conveying air or another carrier gas and carbon dioxide to supersonic speed can take place for example by a nozzle formed in accordance with the Laval principle. Such Laval nozzle geometries are widely known in the prior art.

Furthermore, it should be mentioned that the carbon dioxide supplied to the agglomeration chamber is expediently in fluid form, e.g., liquid.

Further, the dry ice can be emitted from the dry-ice nozzle as a dry-ice jet.

The painting installation may be a painting installation for painting motor-vehicle bodies and/or their attachment parts (e.g. bumpers, buffer strips etc.).

The robots mentioned may be painting or handling robots. The robots, however, in the context of this disclosure comprise any, possibly multi-axis, movement automatons.

This disclosure furthermore covers a painting installation with a cleaning system as described here.

Furthermore, this disclosure covers a cleaning method, to be used in a painting installation, for cleaning at least one component of the painting installation, e.g., at least one component of a painting robot or a handling robot, wherein for cleaning dry ice is applied to the component to be cleaned. Further method steps according to this disclosure will become apparent from the above description of the cleaning system and the description of the figures which follows below.

Figure 2:
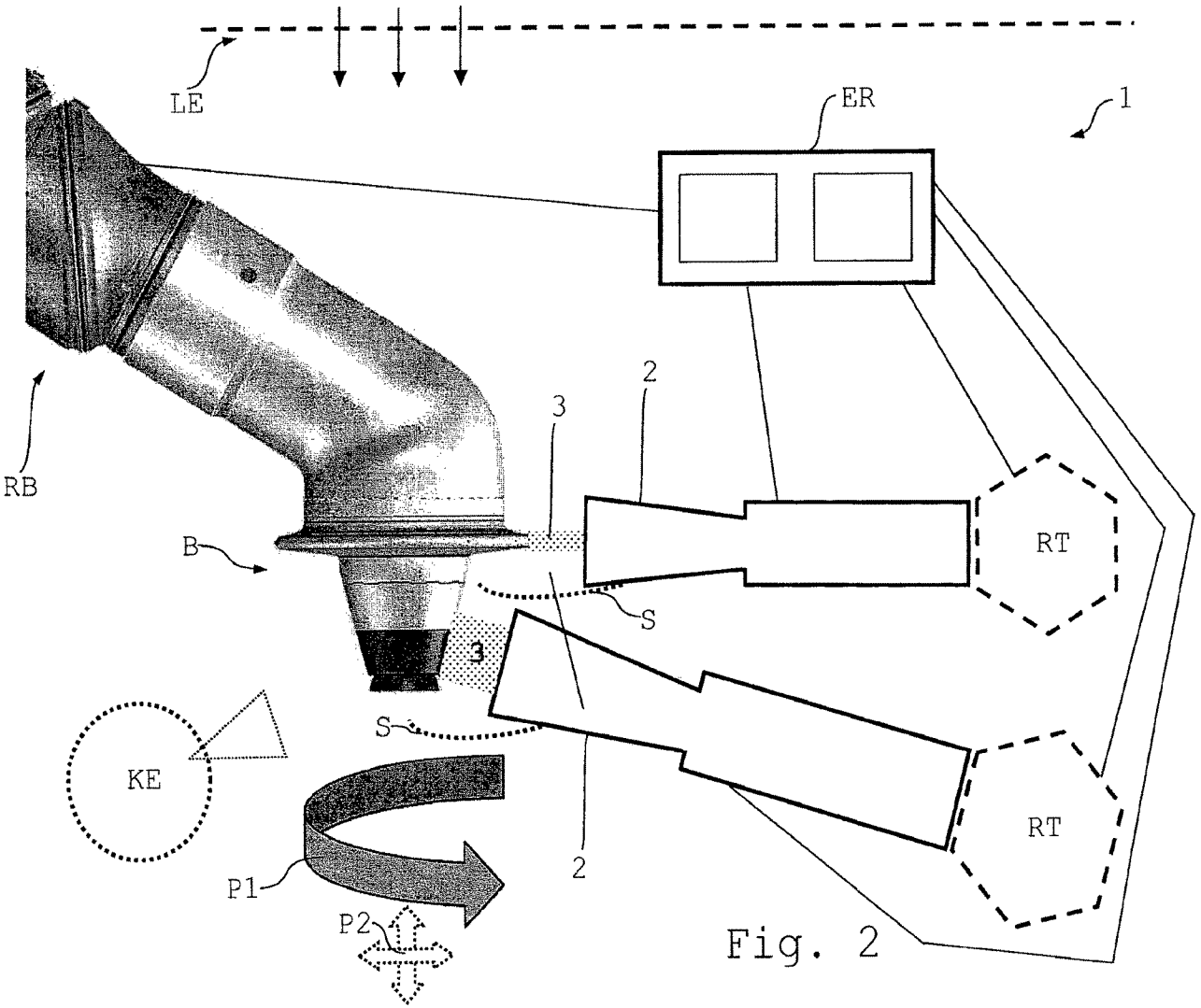
Figure 3:
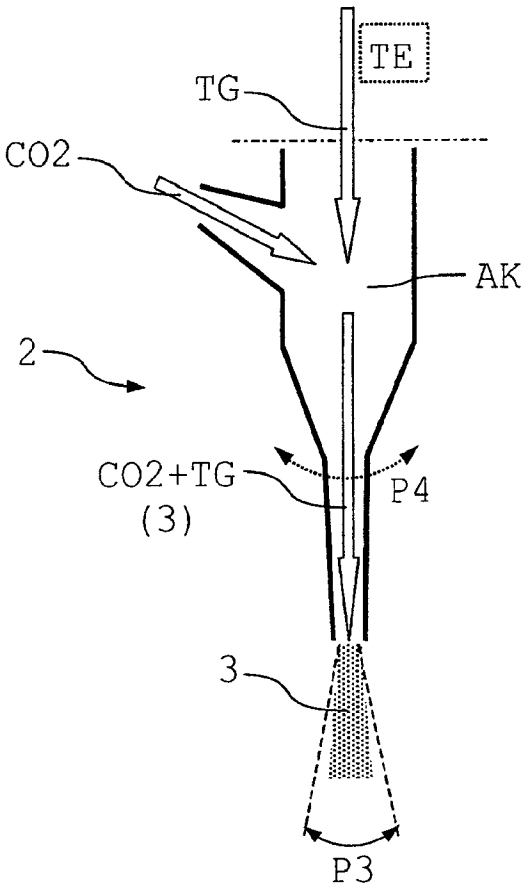
Figure 4:
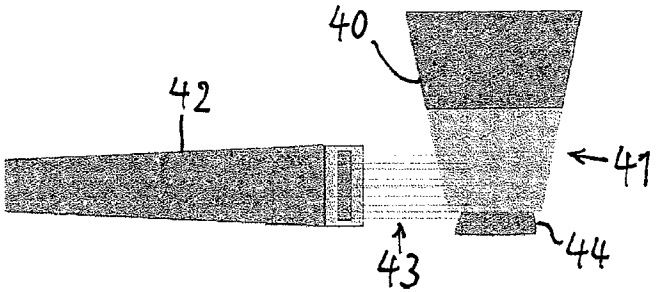
Figure 5:
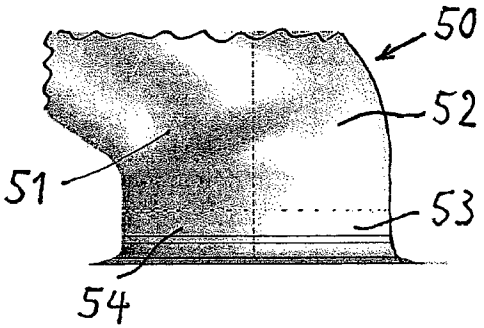

The above features and embodiments according to this disclosure can be combined with each other. Other advantageous developments of this disclosure are disclosed in the sub claims or will become apparent from the description below of preferred examples of embodiment of this disclosure in conjunction with the appended figures. The figures are summarized as follows:

FIG. 1 shows a top view of part of a painting installation in the form of a painting booth, and a cleaning system according to an embodiment, FIG. 2 shows a side view of a part of a cleaning system according to an embodiment, FIG. 3 shows a view of a dry-ice nozzle of a cleaning system according to an embodiment, FIG. 4 shows a schematic representation of the indirect jet exposure and cleaning of a particular part of the coating mechanism, and FIG. 5 shows a possible division of the surface of a component to be cleaned for sequential jet exposure and cleaning.

The embodiments shown in the figures partially correspond, with similar or identical parts being provided with the same reference signs, and for their explanation reference also being made to the description of one or more other embodiments, in order to avoid repetition.

FIG. 1 shows a top view of a part of a painting installation in the form of a painting booth 100, for example, for vehicle bodies or their attachment parts and other parts, and a cleaning system 1 according to an embodiment. In FIG. 1, for clarity only two cleaning systems 1 are provided with reference signs, although a total of six cleaning systems can be seen in FIG. 1. The cleaning system 1 comprises at least one dry-ice nozzle 2 for applying dry ice to a component B to be cleaned. The dry ice is emitted by the dry-ice nozzle 2 in the form of a dry-ice jet, e.g., a jet of carbon dioxide snow.

The component B to be cleaned is borne and guided by a robot RB which is configured such that the robot RB positions the component B to be cleaned in front of the dry-ice nozzle 2 and during the cleaning operation moves, e.g., rotationally, transversely, or translationally moves, the component B relative to the dry-ice nozzle 2. The dry-ice nozzle 2 is arranged in the painting booth 100 in stationary manner. In the example illustrated, the robots RB may typically be painting robots and/or handling robots, and the component B may be the atomiser or handling tool thereof.

The cleaning system 1 comprises a supply device V for supplying the dry-ice nozzle 2 with the dry ice or generally carbon dioxide for producing the dry ice.

For example, the cleaning system 1 comprises a main supply line RL for connecting the supply device V to a plurality of dry-ice nozzles 2 via respectively one stub line SL which branches off from the ring line RL to the respective dry-ice nozzle 2.

The cleaning system 1 furthermore comprises a checking unit KE (e.g. camera sensor, temperature sensor, etc.), which is shown only diagrammatically in FIG. 1, for checking at least one parameter which allows a conclusion to be drawn about the hardware elements associated with the cleaning system 1, the elements necessary for producing the dry ice (e.g., carbon dioxide and carrier gas), the cleaning operation, e.g., the cleaning result, etc.

The checking unit KE is shown separated from the dry-ice nozzle 2 and the robot RB in FIG. 1. In the context of this disclosure, it is however possible for the checking unit KE to be formed in or on the robot RB, on or in the dry-ice nozzle 2 and/or at another suitable position.

It is advantageous that, dependent on the at least one parameter by means of at least one setting means ER (see FIG. 2), at least one output variable of the cleaning system 1 can be set, e.g., regulated and/or controlled, in order to be able to set the hardware elements associated with the cleaning system 1, the elements necessary for producing the dry ice (e.g. carbon dioxide and carrier gas), the cleaning operation, e.g., the cleaning result, etc., according to requirements.

The cleaning system 1 is designed to be explosion-protected. The cleaning system 1 furthermore comprises a valve SV which for safety automatically closes or at least reduces an emission of carbon dioxide if a potential, e.g., imminent, excessive escape of carbon dioxide or one which has already taken place is ascertained by a detection mechanism (e.g. a sensor). By way of example, in FIG. 1 the valve SV is shown at the exit from the supply device V, but can be positioned at a large number of other suitable locations.

FIG. 2 shows a partially schematic side view of a part of a cleaning system 1 according to another embodiment.

FIG. 2 shows two dry-ice nozzles 2 which are respectively carried and guided movably by a schematically-indicated robot RT. The dry-ice nozzles 2 emit dry ice 3 in the form of a dry-ice jet.

The robots RT are configured such that they position the dry-ice nozzles 2 in front of the component B to be cleaned, which here is depicted as a rotary atomiser, and during the cleaning operation move them relative to the component to be cleaned. The robot RT can rotate the dry-ice nozzles 2, e.g., at least partially about the component B to be cleaned, so that the entire outer periphery of the component B to be cleaned can be cleaned by only one dry-ice nozzle 2.

In FIG. 2, the upper dry-ice nozzle 2 cleans an electrode ring of an atomiser, and the lower dry-ice nozzle 2 cleans an atomiser housing and/or the bell cup of the atomiser. It is however also possible for, e.g., only a single dry-ice nozzle 2 to be provided which is guided by a robot RT which is configured such that the robot RT positions the dry-ice nozzle 2 in front of the component B to be cleaned and during the cleaning operation moves the component B, e.g., upwards/downwards to different portions of the component B to be cleaned (e.g., from the electrode ring or electrode fingers to the atomiser housing, and following this to the bell cup and optionally the hand axis of the robot RB). This means that different portions of the component B to be cleaned can be cleaned with a reduced number of dry-ice nozzles.

The dry-ice nozzles 2 may be mounted fixedly or exchangeably on the robots RT. In the latter variant, it is possible for the dry-ice nozzles 2 to be put down automatically after a cleaning operation and to be picked up before a cleaning operation. The robots RT carrying the dry-ice nozzles 2 can be configured accordingly for this purpose.

The dry-ice nozzles 2 comprise a protective element S shown schematically in FIG. 2, which is designed as a protective sheet or protective housing, in order to prevent dirt particles detached during cleaning or dry ice 3 from striking a component to be painted.

The cleaning system 1 shown in FIG. 2 is designed such that the component B to be cleaned can be cleaned in a substantially exposed manner by the dry ice 3 and thus conventional cleaning receptacles, into which the component to be cleaned has to be introduced, can be dispensed with. The cleaning system 1 comprises an air-stream generation mechanism LE which generates a downwards air stream to guide cleaned-off dirt or emitted dry ice 3 downwards, e.g, via a painting booth floor in the form of a grating and out of the painting booth 100. The cleaning system 1 may also comprise a cleaning receptacle, into which the component B to be cleaned is introduced, e.g., by means of the robot RB, in order to clean it by means of at least one dry-ice nozzle 2.

FIG. 2 furthermore shows a schematically illustrated setting means ER, which by way of example is in an operative connection with the robots RT carrying the dry-ice nozzles 2, the dry-ice nozzles 2 and the robot RB carrying the component B to be cleaned, in order to set them according to requirements. The setting mechanism ER can however also be used to set, e.g., the quantity, pressure and temperature of the carrier gas which is miscible with the carbon dioxide and of the carbon dioxide for producing the dry ice 3. It is possible to provide a setting mechanism ER optionally consisting of a plurality of sub-units as in FIG. 1 to set a plurality of elements. It is, however, also possible to provide a plurality of setting mechanisms, which are respectively associated, e.g., with only a single element.

Although the cleaning angle of the upper dry-ice nozzle 2 which is shown in FIG. 2 is substantially horizontal and the cleaning angle of the lower dry-ice nozzle 2 is directed upwards, in the context of this disclosure it is possible for the dry-ice nozzles 2 to be directed downwards during a cleaning operation, so that detached dirt particles can be carried away downwards more easily or more quickly.

It should be mentioned that in the context of this disclosure it is also possible for both a dry-ice nozzle 2 to be carried and guided by a robot RT and for the component B to be cleaned to be carried and guided by a robot RB, and for them to be moved relative to each other during the cleaning process. The movements in such case can be selected at will. For example, the component B to be cleaned can be, e.g., rotated and moved translationally relative to the dry-ice nozzle 2. Likewise, it is possible for the dry-ice nozzle 2, e.g., at least in portions, to be rotated about the component B to be cleaned, and simultaneously or in succession for the dry-ice nozzle 2 to be moved along the component to be cleaned (e.g., from the bell cup to the electrode ring). The movements of the dry-ice nozzle 2 and of the component B to be cleaned may take place simultaneously or in succession.

It should furthermore be mentioned that the dry-ice nozzles 2 shown in FIG. 2, similarly to what is shown in FIG. 1, can also be arranged without the robots RT, e.g., in stationary manner. In this case, the component B to be cleaned may again be positioned in front of the dry-ice nozzles 2 by the robot RB carrying and guiding it, and be moved, e.g., rotated (arrow P1) and/or moved transversely/translationally (arrow P2) relative to the dry-ice nozzles 2.

FIG. 3 shows a view of a dry-ice nozzle 2 of a cleaning system 1 according to an embodiment.

The dry-ice nozzle 2 comprises an agglomeration chamber AK to which fluid carbon dioxide (CO2) can be supplied and in which a two-phase carbon dioxide mixture which comprises carbon dioxide gas and carbon dioxide particles can be formed by agglomeration of carbon dioxide snow crystals. The liquid carbon dioxide supplied to the agglomeration chamber AK is relaxed in the agglomeration chamber AK, and carbon dioxide crystals are produced which are compressed and agglomerated.

The carbon dioxide mixture is mixed with a pressurised carrier gas TG (e.g., compressed air) in the agglomeration chamber AK, preferably in order to accelerate it. In one embodiment of the invention, not shown, it is possible for the agglomeration chamber AK to be connected, e.g., via a metering opening, to a mixing device in the form of a mixing chamber, and for the carbon dioxide mixture to be mixed with the pressurised carrier gas TG in the mixing chamber. In the embodiment shown in FIG. 3, the agglomeration chamber AK so to speak takes on the function of a mixing chamber, so that the agglomeration chamber and the mixing chamber virtually represent one and the same chamber.

It can be seen from FIG. 3 that the dry ice 3 is at least partially carbon dioxide, e.g., a two-phase carbon dioxide mixture which comprises carbon dioxide gas and carbon dioxide particles. The two-phase carbon dioxide mixture is mixed with the pressurised carrier gas TG in the agglomeration and/or mixing chamber before the dry ice 3 is applied from the dry-ice nozzle 2. The dry ice emitted from the dry-ice nozzle 3 is thus preferably a two-phase carbon dioxide mixture which is provided with a pressurised carrier gas TG, and is, e.g., emitted from the dry-ice nozzle 2 in the form of a carbon dioxide snow jet.

The dry-ice nozzle 2 is adjustable in its nozzle contour (e.g., the jet divergence angle can be changed, which is indicated by the arrow P3). Alternatively or additionally, the dry-ice nozzle 2 may comprise an adjustment function to be able to change its orientation, e.g., the cleaning angle. These features make possible adaptation to different outer contours of the component B to be cleaned or generally make the cleaning operation able to be set according to requirements.

The cleaning system 1 may furthermore have a carrier-gas heater TE indicated schematically in FIG. 3 for heating the carrier gas TG.

The cleaning system 1 in the context of this disclosure may comprise a plurality of dry-ice nozzles 2, which are fixedly arranged or can be arranged such that they can preferably cover the entire outer periphery of the component B to be cleaned and/or that they can correspond to the outer contour of the component B to be cleaned.

In an embodiment, not shown, one robot carries both an atomiser and a dry-ice nozzle, which is attached to and arranged on the robot such that the function of the atomiser is not impaired by the dry-ice nozzle. For this purpose, the dry-ice nozzle may be shielded from the atomiser, e.g., by a covering.

FIG. 4 shows the possibility of exposure and cleaning the object to be cleaned optionally partially indirectly with dry ice, by the example of an application component 40 illustrated diagrammatically as a rotary atomiser. The upper part of this component 40 in FIG. 4 can be exposed to the jet directly (not shown), whereas the lower region 41 in the vicinity of the bell cup 44 is indirectly exposed to the jet and cleaned. In this example, the dry-ice nozzle 42 is therefore not directed directly onto the surface of the region 41, which here is cylindrical or conical, but is arranged such that the dry-ice jet 43 brushes laterally or tangentially past the surface to be cleaned. This "spraying-past" has the advantage that, for example, the surface to be cleaned is not deformed or damaged by particles impinging thereon. The spraying-past of the cold carbon dioxide carrier gas mixture in this case effects cooling of the contaminated surface and removal of the soiling by the air stream. Of course, other surfaces can also be indirectly exposed to the jet and cleaned, while yet other component regions can be cleaned by direct application of dry ice to the respective component.

FIG. 5 shows a possible division of the surface of a coating mechanism 50, which is divided into sections for the sequential cleaning. In the example illustrated, the coating mechanism 50 is part of the rotary atomiser of a painting robot (not shown, but cf. robot RB and component B in FIG. 2) with adjacent regions or sections 51, 52, 53 and 54. Each section can be approached separately with a painting robot and then cleaned by the painting robot rotating the coating means 50 in the programmed position 360° about the dry-ice nozzle. After this cleaning, the painting robot can carry on with its "normal" painting activity until the next section is due to be cleaned. The control of the various cycles and dependencies is dictated by the robot control, or they can also be determined and implemented by visual measurement methods for example dependent on the degree of soiling.

The invention is not limited to the preferred embodiments described above. Rather, a large number of variants and modifications, which likewise make use of the inventive concept and therefore fall within the scope of protection, is possible. Protection is claimed for the subject-matter and the features of the individual dependent claims independently of the subject-matter and the features of the claims referred to.

The invention claimed is:

1. A dry ice cleaning system for a component on a robot, the component being one of an atomizer and a handling tool, the robot being located in a paint booth, the system comprising:

at least one stationary dry ice nozzle located in the paint booth;

at least one supply device upstream from the at least one dry ice nozzle;

a checking unit configured to check at least one operating parameter during a cleaning action, at least one output variable of the cleaning system depending on the at least one operating parameter and performance requirements of the cleaning action; and a valve located downstream from the at least one supply device that at least partially closes an emission of carbon dioxide to the dry ice nozzle in response to a risk of excessive escape of carbon dioxide and independent of performance requirements of the cleaning action.

2. A dry ice cleaning system as in claim 1 further comprising an agglomeration chamber upstream from the at least one dry ice nozzle, the agglomeration chamber arranged to receive fluid carbon dioxide such that a carbon dioxide mixture that comprises carbon dioxide gas and carbon dioxide particles is formable by agglomeration of carbon dioxide snow crystals; wherein the carbon dioxide mixture is mixable with a pressurized carrier gas in at least one of the agglomeration chamber and a mixing chamber to accelerate dry ice which is to be applied.

3. A dry ice cleaning system as in claim 2 wherein the liquid carbon dioxide is relaxed in the agglomeration chamber and carbon dioxide crystals are produced that are compressed and agglomerated.

4. A dry ice system as in claim 3 wherein at least one of a quality, pressure and temperature of the carbon dioxide gas which is miscible with the carbon dioxide is settable by at least one setting mechanism to influence the cleaning action before or during the cleaning action.

5. A dry ice cleaning system as in claim 4 including an upper dry ice nozzle for cleaning an electrode ring of an atomizer and a lower dry ice nozzle for cleaning an atomizer housing.

6. A dry ice cleaning system as in claim 1 wherein the at least one operating parameter includes at least one of:

at least one of pressure, quantity, and temperature of carbon dioxide, at least one of pressure, quantity, and temperature of dry ice, at least one of pressure, quantity, and temperature of a carrier gas, a room temperature, a distance between the dry ice nozzle and the component to be cleaned, a position of the component to be cleaned, an orientation of the component to be cleaned, a position of the dry ice nozzle, and an orientation of the dry ice nozzle.

7. A dry ice cleaning system as in claim 1, further comprising a heating device arranged to heat a surface of the component to be cleaned in conjunction with dry ice exposure.

8. A dry ice cleaning system as in claim 7, wherein the heating device is a hot air blower directed onto the surface of the component to be cleaned.

9. A dry ice cleaning system as in claim 7, wherein the heating device operates with infrared radiation.

10. A dry ice cleaning system as in claim 7, further comprising a portion of the component to be cleaned, the portion including channels through which hot air is passed to heat the surface to be cleaned.

11. A dry ice cleaning system as in claim 7, further comprising a portion of the component to be cleaned, the portion including an electric heating device which heats the surface to be cleaned.

12. A dry ice cleaning system as in claim 1, wherein the dry-ice nozzle is a Laval nozzle.

* * * * *